United States Patent [19]

Bryant

[11] Patent Number: 4,540,886

[45] Date of Patent: Sep. 10, 1985

[54] FAIL-SAFE MONITORING SYSTEM

[76] Inventor: Jack A. Bryant, 500 Main St., Melrose, Mass. 02176

[21] Appl. No.: 433,224

[22] Filed: Oct. 7, 1982

[51] Int. Cl.[3] ..... H05B 33/00

[52] U.S. Cl. ..... 250/554; 340/578; 431/79

[58] Field of Search ..... 307/592, 597, 598, 601, 307/311; 250/554, 214 R; 340/578; 431/18, 19, 20, 69, 78, 79; 361/173, 175

[56] References Cited

U.S. PATENT DOCUMENTS

| | | | |
|---|---|---|---|
| 3,852,606 | 12/1974 | Kabat | 250/554 |
| 3,914,662 | 10/1975 | Bianchini | 361/173 |
| 4,038,019 | 7/1977 | Matthews | 431/78 |
| 4,260,362 | 4/1981 | Matthews | 431/78 |
| 4,395,638 | 7/1983 | Cade | 250/554 |

*Primary Examiner*—David C. Nelms
*Assistant Examiner*—J. Gatto
*Attorney, Agent, or Firm*—Robert B. Russell

[57] ABSTRACT

A fail-safe system for monitoring a condition and activating controls in response either to the non-existence of that condition or the failure of any component in the system, in which a preliminary fail-safe oscillation train derived from sensing the condition is converted into a steady state indication of that condition, and a secondary fail-safe oscillation train is generated in a fail-safe way from said steady state indication for further transmission downstream for control purposes. In the context of flame monitoring, means associated with the preliminary oscillation train are provided for discriminating between separate flames and for time delay purposes.

3 Claims, 2 Drawing Figures

FAIL-SAFE MONITORING SYSTEM

FIELD OF THE INVENTION

This invention relates to fail-safe monitoring systems, and more particularly to the detection and processing of signals in such systems. A specific intended use is in flame monitoring.

BACKGROUND OF THE INVENTION

In order for a monitoring system, as for example for monitoring flames, to qualify as "fail-safe" it is necessary that, if the flame (or other condition) is extinguished or becomes non-existent, or if any component in the system fails in either a conducting or non-conducting (operational or inoperative) condition, the system will shut down, or in the flame context, the system will turn off the supply of fuel to the burner being monitored. Usually, the fuel safety shut-off valve in a burner monitoring system is controlled through a relay, by a spring-loaded solenoid, the coil of which must be energized in order for fuel to be supplied to the burner. De-energization of the coil of the solenoid allows the spring to return and close the valve. Such relays and spring-loaded solenoids are so highly reliable that they are considered "fail-safe" and, accordingly, in order to qualify as fail-safe, the possibility of failure of the spring or the valve sticking are not conventionally taken into account. In some systems in which the possibility of such spring or valve failure is regarded as a remote but significant problem, two or more such valve and spring-loaded controls are arranged in series to each burner to further reduce the possibility of unsafe failure at that point in the system.

The classical way that fail-safeness has been attained in flame monitoring systems in the past has been by interrupting the light reaching the photodetector from the flame by means of an intermittently acting shutter which permits bursts of light to reach the photodetector only at a predetermined rate. In this way, during the "flame-on" condition, the output of the photodetector alternates from off to on at the predetermined or characteristic "fail-safe oscillation" rate. Any failure of the shutter or photodetector terminates the "fail-safe oscillation". Likewise, as long as this characteristic, "fail-safe oscillation" , is preserved and continued by the signal processing components between the photodetector and the control element for the fuel supply valve, and the valve control elements are arranged to maintain the fuel valve open only so long as that characteristic output or fail-safe oscillation continues, the system will be fail-safe.

Although such systems have been used for many years, they have numerous drawbacks. For example, the mechanically operated shutters used to create the "fail-safe oscillation" are subject to failure. In addition, such shutters must be interposed in the line-of-sight between the flame and the photodetector. This is inconvenient and expensive. Also the proximity of the shutter to the flame subjects the shutter to intense heat and imposes severe restrictions on the materials and construction of the moving parts, and their drive elements.

Another drawback of such systems stems from the requirement that the closure of the safety shut-off valve be delayed for a short period (usually three seconds in the U.S.A.) in order to account for the case when momentary drop in flame intensity may cause a short cessation of the fail-safe oscillation which may not be indicative of a true flame-out condition. This three second delay requires the use of large and expensive capacitors in the drive circuit for the relay which controls the safety shut-off valve.

Flame monitoring systems not employing mechanical shutters to generate the fail-safe oscillation have been used. In one such system, the photodetector is arranged to detect flame flicker frequencies of about 20 Hz and to transmit them downstream through narrow-band filters. In this way, the fail-safe oscillations are created by the flame itself and are transmitted downstream (usually with resonant enhancement) through the processing circuitry to the fuel valve control circuit. Although such a system avoids the mechanical problems of the shutter-type systems, it still requires large and expensive capacitors for the fuel valve control circuitry and for the above mentioned three second delay. In addition, flicker frequencies in the 20 Hz range are useful only for monitoring single burners. In multiple burner installations, the flame of an operating burner can transmit 20 Hz signals to the photodetector pick-up of an adjacent non-operating burner. Another drawback of systems employing resonant enhancement is the possibility of spurious excitation of the resonant system during a flame "out" condition.

It has been known that reliable discrimination between flames of separate burners can be achieved by filtering the output of the photodetector to eliminate frequencies below say 200 Hz, and to concentrate the output of the photodetector on the higher flicker frequencies (i.e., 200 Hz to 2 KHz) which are detectable only at the root of or along the approximate centerline of any given flame relatively near to the root. Such flicker frequencies, however, vary rapidly and randomly within the 200 Hz–2 KHz range and are, therefore, unsuitable for transmission downsteam as "fail-safe oscillations" to drive fail-safe control circuitry.

Another problem associated with using higher frequencies for generating the "fail-safe oscillations" is that resonances (or resonant inductances) in the system or in the associated equipment may give a false impression of a flame-on condition, and the amplitude of the signals at the higher flicker frequencies drops off drastically. Likewise, the system must be rendered electrically immune to noise spikes which could be caused by closure or activation of switches or circuits, and the danger thereof increases as amplitude lowers and the frequency of the "fail-safe" oscillation increases.

In some cases, however, an opposite situation exists in which the frequency of the "fail-safe oscillation" train, which emanates directly from the condition being sensed, may be so low as to be unsuitable for driving fail-safe control circuitry, and a requirement for introducing, in a fail-safe way a higher frequency "fail-safe oscillation" train for driving the fail-safe control circuitry.

Accordingly, among the objects of the present invention is the provision of means for employing in the same monitoring system a pluralite of different fail-safe oscillation trains adapted for specific purposes together with fail-safe means for activating succeeding trains from a fail-safe output of a previous train. In the context of flame monitoring, an object is to provide a train of "fail-safe oscillations" directly from the flame, through the processing steps to controls without the use of a mechanical shutter and under conditions in which reliable discrimination between flames in a multiple burner installation, is achieved. A further object is to provide, in a fail-safe way, the conversion of a "fail-safe oscillation" train which varies rapdily and randomly over a wide range of frequencies, into a uniform "fail-safe oscillation" train which is more suitable for transmission downstream for activating control circuitry. Still another object is to provide a fail-safe time delay which avoids the use of large and expensive capacitors in the control circuitry. Further objects include providing such a "fail-safe oscillation" train with noise immunity.

BRIEF DESCRIPTION OF THE INVENTION

The present invention accomplishes the foregoing objects in the context of a flame monitor by employing a photodetector and a sighting arrangement which focuses on the root of the flame to be monitored plus a part of the flame along its centerline relatively near to the root. The photodetector is capable of detecting signals from D.C. up to about 10 KHz, but its output is filtered to eliminate frequencies other than between about 200 Hz and 2 KHz. Such frequencies are present only when the flame being monitored is on, and are not detectable from adjacent flames or flames across the firebox. Signals in this frequency range from the photodetector are used as the "fail-safe oscillations" through a preliminary fail-safe stage which is specifically adapted to process such high and randomly varying frequencies. The preliminary fail-safe stage is not required to drive any components having high power consumption and, therefore, it can comprise small and inexpensive elements. The preliminary fail-safe stage is followed by a secondary fail-safe stage into which a second train of fail-safe oscillations is introduced in a fail-safe manner whereby the second train cannot be initiated (or maintained) unless the first fail-safe oscillation train continues as intended. The second fail-safe stage and the second fail-safe oscillation train are adapted specifically to drive the fuel valve control circuits.

A primary feature of the invention is that fail-safe oscillations continue directly from flame to fuel valve control without the use of a mechanical shutter, and under conditions in which effective burner discrimination is achieved. Another feature is that by using two separate fail-safe stages, the first of which has low power requirements, a small, inexpensive and reliable delay component (e.g., three second delay), can be employed in the first stage, and thereby eliminate it from the final fail-safe stage where large size and expensive delay components would otherwise have to be used.

Still another feature resides in the use of two (or more) separate fail-safe stages and coupling them in a fail-safe manner. This is done by employing the fail-safe oscillations in the preliminary fail-safe stage to operate a "pumping" circuit in which current is caused to flow around a closed loop as long as the oscillations continue above a suitable amplitude. Such a direct current loop may be provided with time delay means which continues the flow of current (above a given value) for a suitable delay period.

Coupling of the preliminary fail-safe stage to the secondary fail-safe stage is done by arranging a current detector in the direct current loop, and by shunting the direct current across the current detector at a predetermined rate, such as 100 Hz, to create an on-off condition oscillating uniformly at 100 Hz for the current detector the output of which can be used downstream as a 100 Hz fail-safe oscillation in the secondary fail-safe stage. Again, it will be appreciated that any cessation of the direct current in the direct current loop or any failure of the direct current detector or the shunt or the 100 Hz generator, in either a conducting or a non-conducting condition, will terminate the secondary fail-safe oscillations.

The 100 Hz secondary fail-safe oscillations are then used in a second fail-safe "pumping" circuit to control the generation of a direct current for the output relay which controls the fuel supply valve. The features of this arrangement are that the 100 Hz secondary fail-safe oscillations are ideal for the efficient generation of the driving direct current, and that the three second delay can be accomplished in the preliminary fail-safe stage with small, inexpensive and more reliable components. Equally, however, the arrangement can be used to convert a lower frequency preliminary fail-safe oscillation in to one of higher frequency or an oscillation having a specific desired waveform.

By employing sequential fail-safe stages and coupling them in an isolated but yet fail-safe manner, the present invention avoids the use of switching or feed-back circuits which could influence the fail-safe oscillations. This is important in that it eliminates, or substantially reduces, the possibility of noise interference.

Another feature is that the fail-safe signals in the preliminary fail-safe stage may be transformed from analog to digital prior to introduction into the first "pumping" circuit. This has the advantage of providing standardized signals in place of signals of randomly varying amplitude and frequency, and thereby provides more reliable operation of the pumping circuit in the preliminary fail-safe stage.

DETAILED DESCRIPTION OF THE INVENTION

The monitoring system of the present invention applies to monitoring any condition such as pressure, temperature, liquid level, valve closure condition and the like. It has special advantages in the context of flame monitoring and, therefore, it is described herein in that context.

The general functioning of the stages is as follows. In Stage A a preliminary fail-safe oscillation is generated. (The term "fail-safe oscillation" is intended herein to mean an oscillation emanating either directly or through a fail-safe coupling, from the flame). In Stage B the preliminary fail-safe oscillation from A is converted into a continuous fail-safe direct current. In Stage C, the direct current of B is detected and transmitted downstream by a fail-safe coupling in an interrupted or "chopped-" manner to create a secondary fail-safe oscillation, and, in Stage D the secondary fail-safe oscillation of C is used to drive a fail-safe output circuit which controls the fuel valve to the burner.

Figure 1:
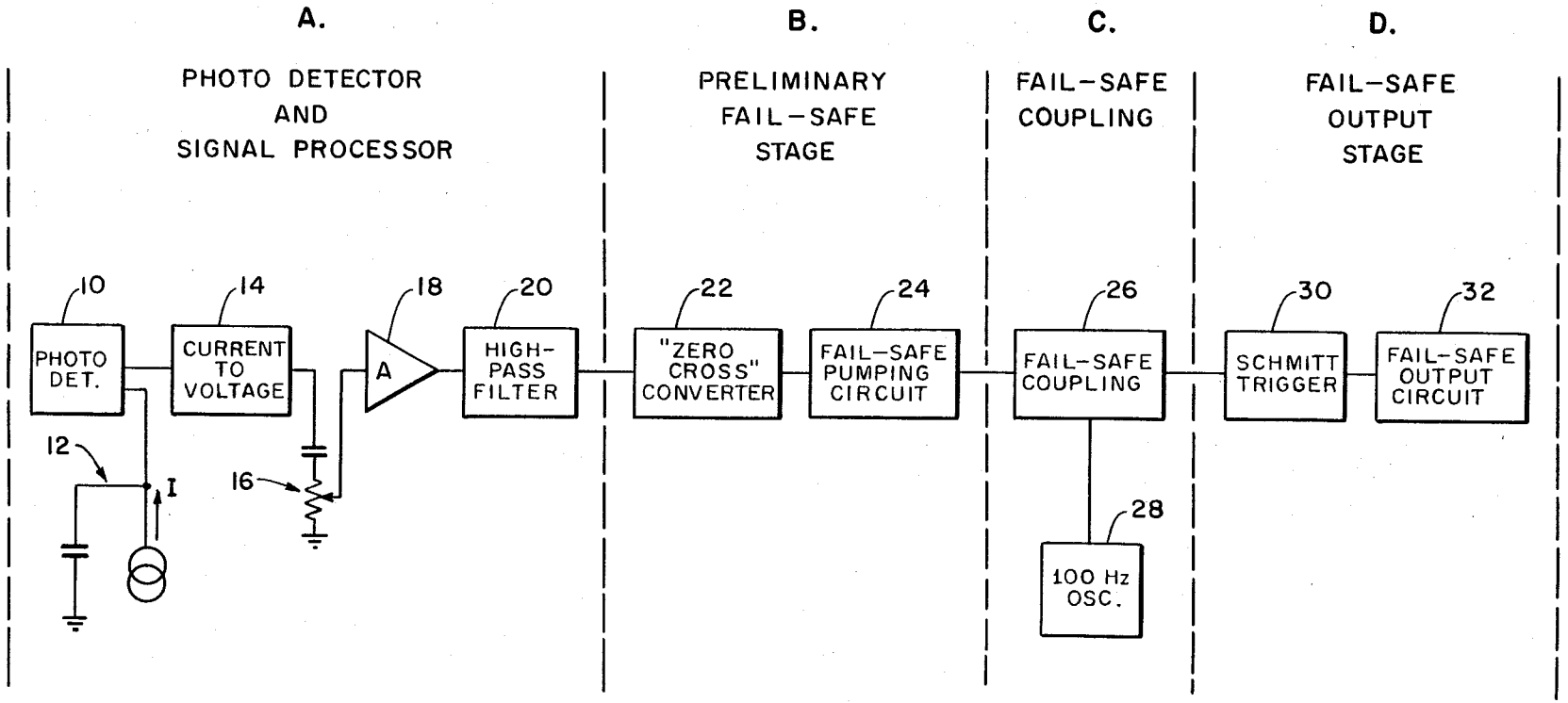
FIG. 1 is a block or "logic" diagram of the system of the present invention.

As shown in FIG. 1, Stage A comprises a photodetector 10 which may be an IR detector of the PbS type which is particularly useful in certain modes of operation of the invention. Other modes of operation, however, which also form part of the invention do not require such a photodetector. Therefore, in its broadest aspect the invention is not limited to the type of photodetector used.

Signals are derived from photodetector 10 by biasing with a capacitor-bypassed-constant current generator indicated at 12. A current responsive to flicker in the flame is generated when flame is present and this current is converted to a voltage by a current to voltage converter 14. By these means a suitable signal to noise ratio is obtained.

The output of converter 14 is capacitor coupled to a potentiometer gain control indicated at 16, the output of which is fed to a voltage amplifier 18, which, in a preferred embodiment has a gain of x147.

The output of amplifier 18 is fed to a highpass filter 20 with a cut-off frequency of 154 Hz. The net result of highpass filter 20 and the RC time constants associated with gain control 16 creates a passband from approximately 200 Hz to 2 KHz with a gradual attenuation of frequencies above and a more abrupt attenuation below. Thus, the definition herein of the range of frequencies as being "about 200 Hz to 2 KHz" is intended to include that specific range plus a certain attenuating band above and below that range. Flicker frequencies in the range are generated at suitable amplitude at the root of a flame and for an additional distance along the centerline of the flame. Such frequencies, however, are not transmitted from adjacent flames or from flames across the firebox, due to spacial averaging from more distance flames. In this way, the flicker frequencies transmitted by filter 20 indicate the presence of flame at the particular burner being monitored even in the context of a multiple burner installation. In addition, the oscillations of the signal emanating from filter 20 qualify as fail-safe oscillations as herein defined because they emanate directly from the flame and the only way they can continue is for the flame to continue. Up to this point, the components of Stage A only have been described.

In Stage B a preliminary "fail-safe" control operation is performed using the preliminary fail-safe oscillations of Stage A. Since the oscillations emanate directly from the flame and cover a relatively wide range of relatively high frequencies, it is desirable to condition the signals prior to use. This is done by means of a "zero cross" converter 22 which will be described in detail below. Converter 22 effectively converts the bipolar analog signals from Stage A (above a given amplitude) into positive going, digital (rectangular) pulses. These pulses, which still are classifiable as preliminary fail-safe oscillations, are then fed to pumping circuit 24 in which a continuously circulating direct current is created, but only so long as the preliminary fail-safe oscillations from Stage A continue.

In Stage C the direct current of Stage B is processed in a fail-safe coupling 26, to be described in more detail which, by the use of a 100 Hz oscillator 28, chops the output of coupling 26 so that it transmits downstream a secondary fail-safe oscillation train of 100 Hz pulses. It is important to note that the chopping action occurs in the direct current circuit of Stage B upstream of the output of the coupler. This is necessary for the system to be fail-safe.

In Stage D the pulses from Stage C are processed through a Schmitt trigger 30, and then used to drive a fail-safe output pumping circuit 32.

Figure 2:
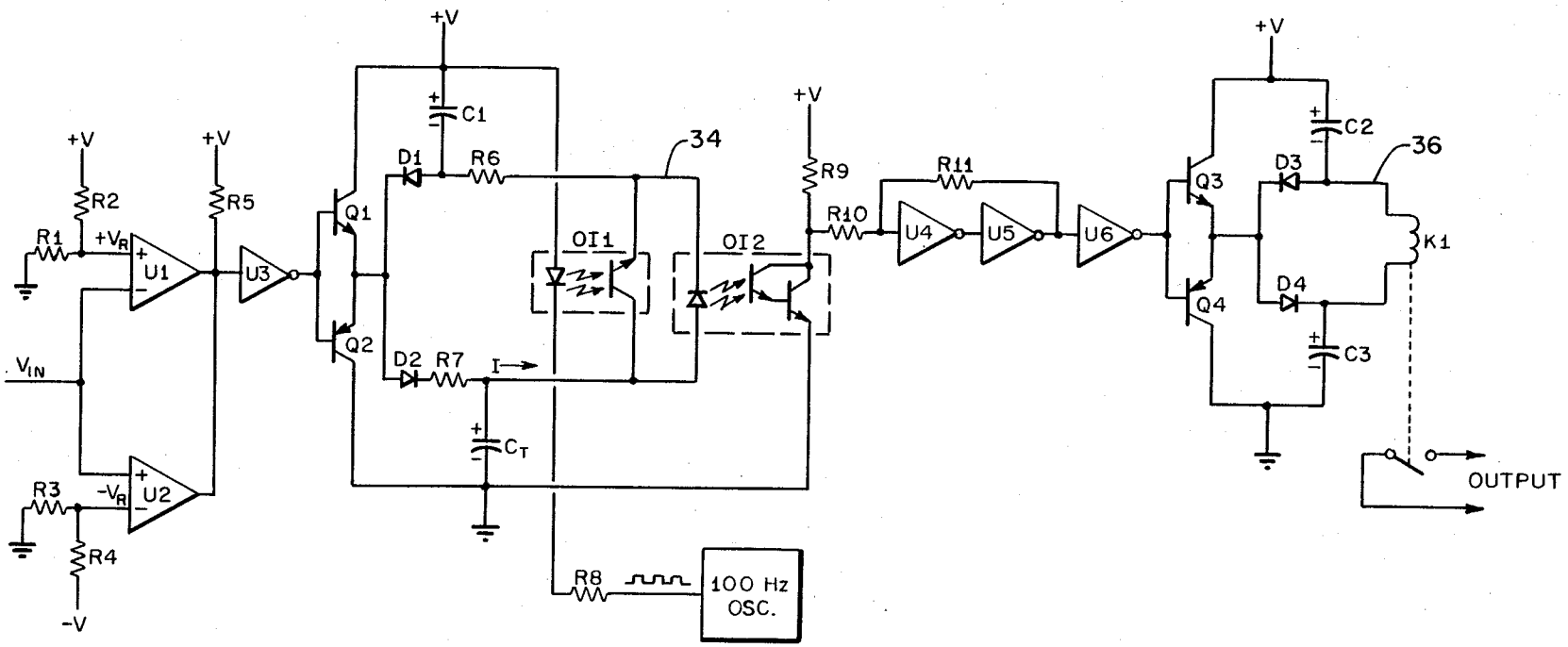
FIG. 2 is a detailed circuit diagram of the principal components.

The operation of Stages B, C and D will be better understood from a detailed description of a specific circuit as shown in FIG. 2. In this figure, Vin represents the bipolar analog signal from Stage A which is fed to integrated circuit (IC) voltage comparators U1 and U2 which comprise the "zero cross" converter 22 of Stage B. In this converter, reference voltages $+V_R$ and $=V_R$ are applied respectively to U1 and U2 such that the outputs of U1 and U2 are high with no signal in. The reference voltages are 1/13 the $\pm V$ supply voltages so that $+V_R=0.8(+V)$ and $-V_R=0.8(-V)$. A flame signal (at Vin) with amplitude excursions above $+V_R$ and below $-V_R$ will cause the outputs of U1 and U2 to switch ON and OFF creating rectangular pulses at the output of a digital inverting buffer amplifier U3. The output of U3 is used to drive transistors Q1 and Q2 as will be further explained. The combined outputs of U1 and U2 create a digital signal switching between $+V$ and ground.

The digital signals from "zero cross" converter 22 are fed to preliminary fail-safe pumping circuit 24, the initial components of which are transistors Q1 and Q2 which are arranged (with associated circuitry) to switch alternately ON and OFF as the output of U3 swings between $+V$ and ground. The pumping circuit 24 compromises a closed loop 34 arranged with diodes D1 and D2 to permit direct current flow in only one direction. Q1 and Q2 are connected in series between $+V$ and ground, and closed loop circuit 34 is connected between Q1 and Q2 at the junction of diodes D1 and D2. Also closed loop 34 is provided with capacitors C1 and CT and resistors R6 and R7 (R6 may be a constant current regulating diode), such that switching on Q1 allows current to enter closed loop 34 and flow around it up to C1 (for a finite period dependent on the value of C1) and switching OFF Q1 and switching ON Q2 causes current to flow around loop 34 from CT, through D1, and out to ground through Q2 for a finite period dependent on the value of CT. Thereafter, only if a continuous train of preliminary fail-safe oscillations is present from the flame through U3, will current continue to flow in loop 34. Stage B is fail-safe because failure of any component in either a conducting or non-conducting mode will terminate the flow of current in loop 34. In addition, the system as described avoids problems at the time of switching on the power.

The values of C1 and CT are selected initially so that the current in loop 34 will remain substantially constant when the preliminary fail-safe oscillations at U3 correspond to the lowest flicker frequencies in the range selected by Stage A. The term "substantially constant" as used in this context means sufficiently constant to operate a current detector OI2 in Stage C, to be described.

In addition, the value of CT can be selected to provide current flowing around part of loop 34 and out through Q2 for an additional delay period of say three seconds so as to continue the flow in case a false and momentary flame-out condition appears at photodetector 10. Since current detector OI2 can be a low power element such as an optical isolator (i.e., photodarlington transistor driven by an LED), the voltage and current requirements of pumping circuit 24 can be very small, and capacitors C1 and CT can likewise be small. This permits substantial space saving and the use of highly reliable tantalum capacitors the cost of which would be prohibitive if they had to be large enough to drive K1, the relay that controls the safety shut-off valve for three seconds. Another advantage of these low power requirements for pumping circuit 24 is that a plurality of timing capacitors CT can be used together with switching to provide different time delays as required. Three such capacitors can be provided with binary switching to provide seven different delay periods. This latter feature is regarded as a significant improvement and is intended to be claimed broadly in the context of a low-power preliminary fail-safe pumping circuit.

In operation, when signals are continuously present at U3, CT will be more-or-less fully charged and will cause current to flow in loop 34 for approximately three seconds after an abrupt cessation of such signals. If, however, short bursts of such signals continue, as with a "dirty" flame, or a flame of low caloric content, CT may continue with less than a full charge, and the flow of current in loop 34 will stop after a total cessation of signals, in proportionately less time than three seconds. The circuit, therefore, performs a quasi averaging function to the extent that, if the current in loop 34 stops, the operator knows either that for a period of about three seconds there have been no signals at all, or that the average duration of such signals has not come up to a preselected minimum.

The value of CT is selected according the desired time delay after a cessation of signals, C1 is chosen according to the lowest frequency of the output of U3. R7 is chosen for noise immunity purposes to prevent CT from charging too rapidly. R6 is chosen in relation to CT limit the current flow to achieve the desired time delay, while still providing sufficient current for the optical isolators OI1 and OI2 (about 680 microamps).

In Stage C, optical isolator OI2 is used to detect current flowing in loop 34 downstream of CT. When current passes through the LED (light emitting diode) of OI2, the photodarlington of OI2 turns ON, indicating the flow of current in loop 34. In order, however, to interrupt or "chop" the operation of OI2 while current continues to flow in loop 34, an optical isolator OI1 is shunted across OI2 and rendered conducting in an interrupted manner by 100 Hz oscillator 28. Thus, during each positive going cycle of oscillator 28, OI1 shunts the current in loop 34 across OI2 and renders OI2 temporarily inoperative. In this way, as long as the current in loop 34 remains substantially constant a chopped secondary fail-safe oscillation is transmitted downstream by OI2 and the system remains fail-safe because the chopping occurs upstream of the output of OI2. The frequency of the secondary oscillation is 100 Hz in the example given. The frequency of 100 Hz is chosen because it is high enough to permit the use of relatively small capacitors C2 and C3 in the output circuit, and still obtain the current gain advantages of the photodarlington OI2. In addition, the output of OI2, after appropriate shaping by the Schmitt trigger (U4, U5), unencumbered by a time delay function, is ideal for driving a fail-safe output circuit. It is believed, therefore, that the selection of 100 Hz is highly desirable and independently claimable in the context of fail-safe coupling to a preliminary fail-safe stage which can be of higher or lower frequency. Even if the two are the same frequency, separation of the two fail-safe oscillation trains can have important advantages for time delay or wave shaping purposes.

In Stage D, the output of OI2 is passed through a Schmitt trigger 30 (R10, U4, U5 and R11), and inverter driver U6 to fail-safe output circuit 32 which comprises a closed loop 36 arranged similarly to loop 34 as a pumping circuit fed by transistors Q3 and Q4. A coil K1 of the relay which controls the solenoid of the safety shut-off valve (not shown) is energized by current flowing in loop 36, and capacitors C2 and C3 are employed to continue the flow in loop 36 through K1 in a substantially continuous manner. Since the secondary fail-safe oscillations are uniform 100 Hz pulses, the values of C2 and C3 can be selected very accurately in relation to the resistance of K1 and its current requirements, thereby bringing space, and cost as well as operational advantages in the nature of filtering. The fail-safe aspect of the preliminary fail-safe stage composed of Q1, Q2, D1, D2, D6, R7, $C_1$, $C_T$ and the optical isolator O12 can be explained as follows: With no flame signal Q1 is OFF and Q2 is ON. $C_T$ is discharged and $C_1$ is charged (negative side at ground potential). The first appearance of flame will cause an oscillating signal to appear at the output of U3 which causes Q1 to turn ON and Q2 to turn OFF resulting in $C_T$ charging through D2 and R7. At the same time $C_1$ will begin to discharge but before it can discharge to any extent due to the oscillations of the output of U3 Q1 and Q2 will reverse state causing $C_1$ to charge again through D1. The pumping action of Q1 and Q2 with flame present will cause CT to quickly charge to a relatively high voltage (compared to the negative side of $C_1$) resulting in a current flowing through the LED of OI2. As long as flame is present a current (I) will continuously flow through R6 via LED of O12 or phototransistor of OI1 (depending on the state of 100 Hz oscillator output which will divert the current (I) flowing through LED of OI2 through the phototransistor of OI1). Any one of the components composing this fail-safe timing circuit can fail, either shorted or open, resulting in the discharge of $C_T$ (or $C_1$, depending on the state of Q1 and Q2) and causing the flow of current through OI2 and R6 to stop.

The fail-safe aspect of the secondary fail-safe stage composed of Q3, Q4, D3, D4, C2, C3 and relay K1 is essentially the same as the preliminary fail-safe circuit. With flame present the output of U6 is a uniform square-wave in step with the 100 Hz oscillator. When Q3 is ON, Q4 is OFF, causing C3 to charge and C2 to discharge and with Q3 OFF and Q4 ON C3 discharges through K1 relay coil. This pumping action causes a current to continuously flow through K1 keeping the flame relay contacts energized. A failure of any component composing this circuit (or, for that matter, any component upstream) will cause K1 to de-energize.

Noise immunity is incorporated at two points in this system. The thresholds of the "zero cross" detector (R1, R2, R3, R4, U1, U2, U3 and R5) have been purposely raised so that a flame signal must have a peak level that exceeds the reference voltages $+V_R$ and $-V_R$. The resistor R7 prevents CT from charging on a short noise pulse where Q1 might turn on for a very short time. R7 is 1/10 the value of R6 which results in a charging of the timing capacitor CT in 1/10 the flame out time delay. Also, AC power line interference is minimized by the highpass filter rejecting frequencies below 154 Hz.

The Schmitt trigger circuit, composed of U4, U5, R10 and R11, in the secondary fail-safe Stage D is used to present a more uniform square pulse to the output driver U6 and the subsequent switching transistors Q3 and Q4.

It will now be seen that the invention provides an economic and effective way to monitor flames and control fuel safety shut-off valves without the need for massive capacitors in the output circuits. It also permits monitoring flames in multiple burner installations with discrimination between flames, and without the use of mechanical shutters. It permits obtaining one or more time delays in an economic manner. It provides a completely fail-safe control which is immune against random noise or other interference.

While I have shown the invention in the context of a flame monitoring system, it will be appreciated that other conditions can be monitored using the invention, and as long as the output of the condition sensor oscillates when the condition having sensed exists and the sensor returns to a steady on or steady off state when that condition no longer exists, or if the sensor fails, the system and many of its advantages can be used. Also the invention is not limited to the number of succeeding fail-safe (and coupling) stages in series or in parallel, or combinations thereof, and fail-safe oscillations of different frequencies and/or waveforms can be selected as may be appropriate for different uses at different fail-safe stages. Thus, signals of randomly varying frequency and amplitude can be used for one of the fail-safe oscillation trains together with detection and processing components specifically adapted to handle such signals, and a subsequent fail-safe oscillation train can be provided downstream with a totally different frequency and waveforms which is better suited for further transmission or control purposes.

Since further modification will now be apparent to those skilled in the art, it is not intended to confine the invention to the precise form herein shown but to limit it only in terms of the appended claims.

I claim:

1. A fail-safe system for detecting whether or not a given variable physical condition exists in a given one of a plurality of possible states and for holding an on-off type control in the on state only while said given one state continues, comprising:

(a) means for detecting the existence of said given one state and for generating an oscillating electrical signal only while said given one state continues;

(b) a direct current circuit in the form of a loop;

(c) means responsive to said oscillating signal for generating an uninterrupted direct current flowing around said loop;

(d) an oscillator for generating a second oscillating electrical signal;

(e) means responsive to said oscillator for shunting the flow of current in said loop across a given portion of said loop to cause the flow of current in that portion to be interrupted at the frequency of said oscillator;

(f) means responsive to the flow of current in said portion of said loop for generating a signal having the frequency of said oscillator;

(g) fail-safe means for actuating a control from an "off" to an "on" condition; and (h) means responsive to the signal generated by the flow of current in said portion of said loop for actuating said control;

whereby, non-existence of said one given state or any failure of any component in any element as defined, leaves said control in the "off" condition.

2. The system defined in claim 1 further characterized by:

timing means for continuing the flow of current in said loop for a selected interval following the termination of signals from said detecting means.

3. The system defined in claim 1 further characterized by:

said control comprising a second direct current circuit in the form of a loop, a direct current driven actuator in said loop circuit and driven thereby, means including at least two diodes and two capacitors responsive to the signal generated by the flow of current in said portion of said first named loop for generating an uninterrupted flow of direct current around said loop to activate said actuator, whereby the frequency of said oscillator is independent of the frequency generated at the detecting means and said oscillator can be selected to have a sufficiently high frequency to permit the use of small and inexpensive capacitors in said control.

* * * * *